US009050700B2

(12) United States Patent
Chen et al.

(10) Patent No.: US 9,050,700 B2
(45) Date of Patent: Jun. 9, 2015

(54) METHODS AND APPARATUS FOR AN IMPROVED POLISHING HEAD RETAINING RING

(75) Inventors: Hung Chih Chen, Sunnyvale, CA (US); Jay Gurusamy, Santa Clara, CA (US); Gautam S. Dandavate, Sunnyvale, CA (US); Samuel Chu-Chiang Hsu, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 362 days.

(21) Appl. No.: 13/360,221

(22) Filed: Jan. 27, 2012

(65) Prior Publication Data

US 2013/0196577 A1 Aug. 1, 2013

(51) Int. Cl.

*B24B 1/00* (2006.01)
*B24B 37/32* (2012.01)
*B24B 37/34* (2012.01)

(52) U.S. Cl.

CPC ..... *B24B 37/32* (2013.01); *B24B 37/34* (2013.01)

(58) Field of Classification Search

CPC ..... B24B 37/32; B24B 37/34; B24B 37/30
USPC ..... 451/41, 285–290, 398
See application file for complete search history.

(56) References Cited

U.S. PATENT DOCUMENTS 6,068,549 A 5/2000 Jackson
6,267,643 B1 7/2001 Teng et al.
6,272,902 B1 8/2001 Chen et al.
6,375,549 B1 * 4/2002 Glashauser et al. ..... 451/41
6,506,105 B1 1/2003 Kajiwara et al.
6,835,125 B1 * 12/2004 Tseng et al. ..... 451/398
6,890,249 B1 * 5/2005 Zuniga et al. ..... 451/398
7,063,604 B2 * 6/2006 Spiegel ..... 451/285
7,118,456 B2 10/2006 Moloney et al.
7,699,688 B2 * 4/2010 Zuniga et al. ..... 451/442
7,950,985 B2 * 5/2011 Zuniga et al. ..... 451/398
8,469,776 B2 * 6/2013 Zuniga et al. ..... 451/398
2004/0137739 A1 7/2004 Korthuis et al.
2005/0037698 A1 2/2005 Zuniga et al.
2005/0113002 A1 5/2005 Chen et al.
2008/0051011 A1 2/2008 Moloney et al.
2008/0066862 A1 3/2008 Gunji et al.

(Continued)

FOREIGN PATENT DOCUMENTS

JP 2010-040604 2/2010

OTHER PUBLICATIONS

International Search Report and Written Opinion of International Application No. PCT/US13/021399 mailed Apr. 29, 2013.

(Continued)

*Primary Examiner* — Maurina Rachuba
(74) *Attorney, Agent, or Firm* — Dugan & Dugan, PC

(57) ABSTRACT

Methods, apparatus, and systems are provided for retaining a substrate in a polishing head of a CMP system. The invention includes a flexible inner retaining ring adapted to contour to an edge of a substrate and an inner ring support coupled to the polishing head. The inner support ring is adapted to contact the flexible inner retaining ring in response to a side force load applied to the flexible inner retaining ring by a substrate being polished. Numerous additional aspects are disclosed.

20 Claims, 8 Drawing Sheets

(56) References Cited

U.S. PATENT DOCUMENTS

| | | | | |
|---|---|---|---|---|
| 2009/0111362 | A1 | 4/2009 | Nabeya et al. | |
| 2009/0221223 | A1 * | 9/2009 | Zuniga et al. | 451/385 |
| 2010/0112905 | A1 | 5/2010 | Borucki et al. | |
| 2013/0288577 | A1 | 10/2013 | Chen et al. | |

OTHER PUBLICATIONS

International Preliminary Report on Patentability and Written Opinion of International Application No. PCT/US2013/021399 mailed Aug. 7, 2014.

* cited by examiner

METHODS AND APPARATUS FOR AN IMPROVED POLISHING HEAD RETAINING RING

FIELD OF THE INVENTION

The present invention generally relates to electronic device manufacturing using chemical-mechanical planarization, and more particularly is directed to methods and apparatus for an improved polishing head retaining ring.

BACKGROUND OF THE INVENTION

Chemical-mechanical planarization (CMP) systems use a polishing head to press and rotate a substrate against a polishing pad during processing. During the polishing process, a substrate within a polishing head is held within the head using a retaining ring which encircles the substrate and prevents the substrate from being dragged out of the polishing head by the relative movement of the polishing pad. The inventors of the present invention have noticed that in some cases, the retaining ring may prematurely wear. Thus, what is needed are improved methods and apparatus for retaining a substrate within a polishing head during processing.

SUMMARY OF THE INVENTION

Inventive methods and apparatus are provided for retaining a substrate within a polishing head during processing. In some embodiments, the apparatus includes a flexible inner retaining ring adapted to contour to an edge of a substrate; and an inner ring support coupled to the polishing head and adapted to contact the flexible inner retaining ring in response to a side force load applied to the flexible inner retaining ring by a substrate being polished.

In some other embodiments, a polishing head system is provided. The polishing head system includes a flexible inner retaining ring adapted to contour to an edge of a substrate; an inner ring support coupled to the polishing head and adapted to contact the flexible inner retaining ring in response to a side force load applied to the flexible inner retaining ring by a substrate being polished; and a housing enclosing the flexible inner retaining ring and the inner ring support.

In yet other embodiments, a method of retaining a substrate in a polishing head during processing is provided. The method includes applying a side force to a substrate to be polished via a rotating polishing pad; contacting a flexible inner retaining ring with an edge of the substrate; and contouring the flexible inner retaining ring to the edge of the substrate by contacting the flexible inner retaining ring with an inner ring support coupled to the polishing head in response to the side force being applied to the flexible inner retaining ring by the substrate being polished.

In still yet other embodiments, an alternate apparatus for retaining a substrate in a polishing head during processing is provided. The apparatus includes a flexible inner retaining ring adapted to contour to an edge of a substrate; and an outer retaining ring coupled to the polishing head and including a notch adapted allow the flexible inner retaining ring to flex in response to a side force load applied to the flexible inner retaining ring by a substrate being polished.

Numerous other aspects are provided. Other features and aspects of the present invention will become more fully apparent from the following detailed description, the appended claims and the accompanying drawings.

DETAILED DESCRIPTION

Figure 8:
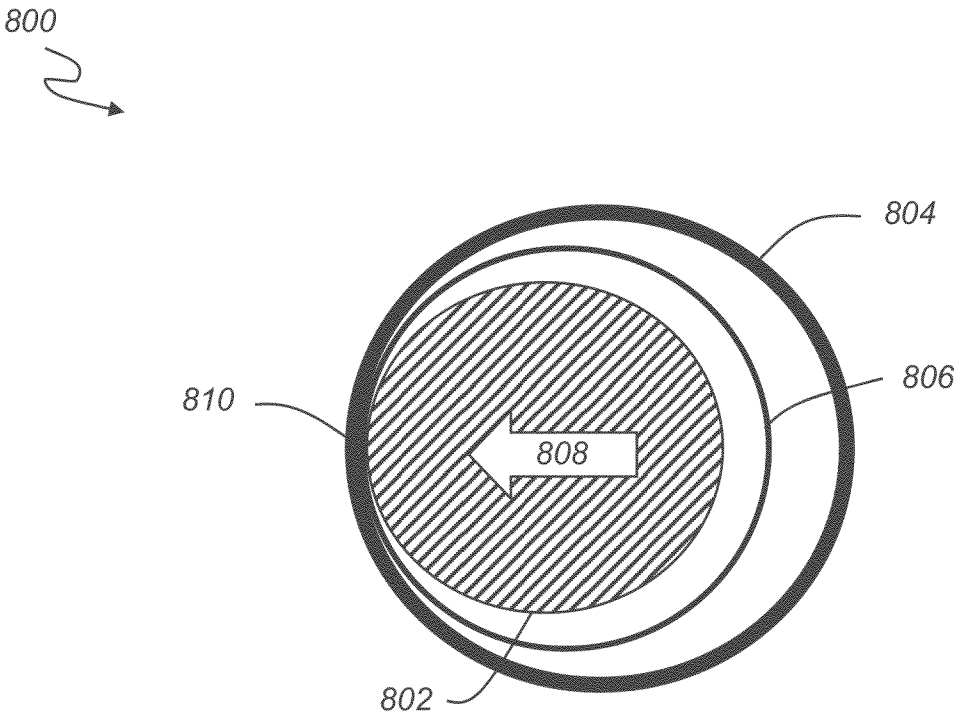
FIG. 8 Prior Art
FIG. 8 is a schematic diagram depicting a conventional polishing head retaining ring design according to the prior art.

The present invention provides methods and apparatus for an improved retaining ring of a polishing head of a chemical-mechanical planarization (CMP) system. Referring to FIG. 8, during the polishing process in a conventional CMP system, the substrate 802 inside of a polishing head 800 comes into contact with a retaining ring. In some systems, the retaining ring is a one-piece design and, in others, the retaining ring includes two pieces: an outer ring 804 and an inner ring 806 as shown in FIG. 8. In either of these designs, the substrate 802 has a smaller diameter than the retaining ring 806. In operation, the rotation of the polishing pad pushes the substrate 802 against the retaining ring 806. The lateral force applied to the substrate 802 by the polishing pad and against the retaining ring 806 by the substrate 802 is referred to as "side force" 808. The polishing head applies a downward force on the substrate that pushes the substrate against the polishing pad referred to as "membrane pressure." The polishing head also applies a rotational force to the substrate.

As a result of the side force 808 in a conventional polishing head 800, a point contact 810 is realized between the substrate 802 and the inside surface of the retaining ring 806. This focused load places a large amount of stress on the retaining ring 806. Further, with larger substrates, at any given membrane pressure, the side force of the substrate against the retaining ring is increased. The inventors of the present invention have determined that at larger substrate sizes with larger membrane pressures, this focused force would create unacceptable localized stress levels within the retaining ring leading to component failure.

Embodiments of the present invention use a flexible inner retaining ring to support and distribute the substrate's side force load. This increases the contact area of the substrate on the retaining ring by allowing the flexible inner retaining ring to contour to the substrate's edge. As a result of the increased contact area, the side force load is distributed over a larger area and lower stress levels on the retaining ring are achieved. With the larger diameter substrates and larger polishing pressures, the present invention thus reduces the likelihood of component failure from unacceptably high material stress.

Figure 1:
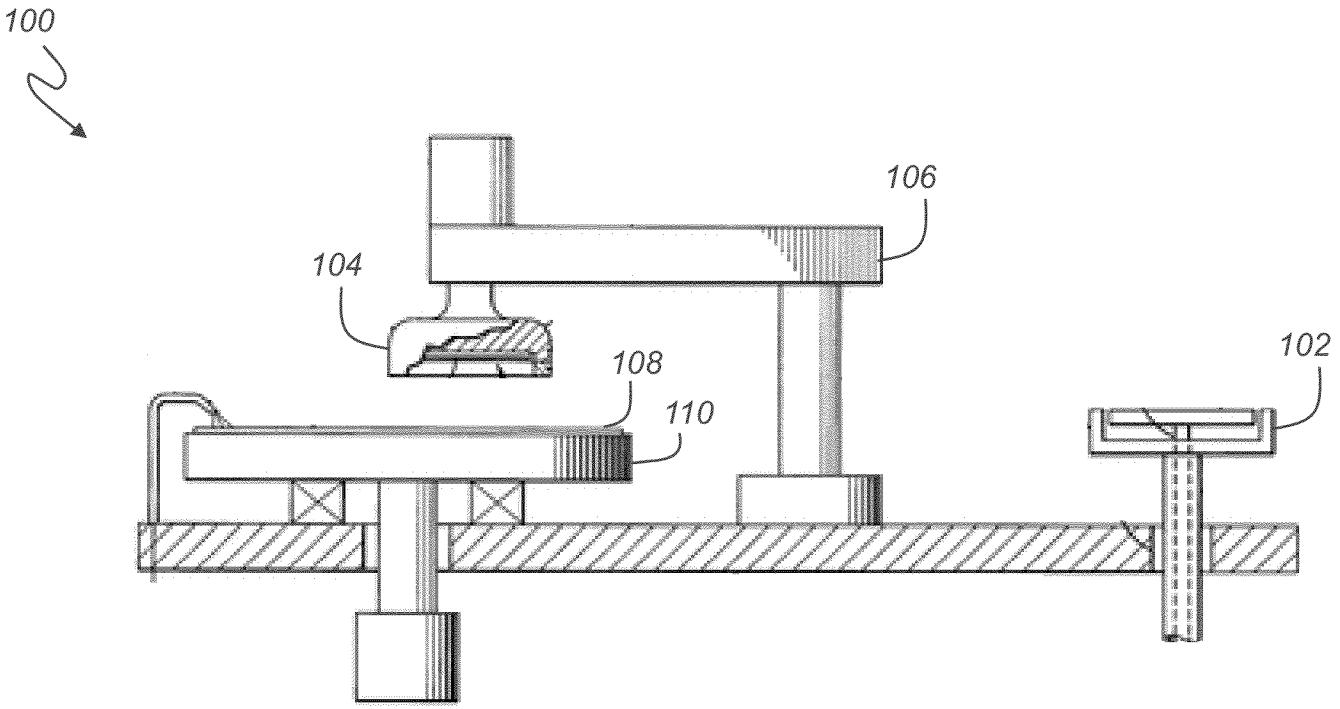
FIG. 1 is a diagram depicting a side view of an example chemical-mechanical planarization (CMP) system for polishing substrates according to embodiments of the present invention.

Turning to FIG. 1, a side view of an example chemical-mechanical planarization (CMP) system 100 for polishing substrates is shown. The system 100 includes a load cup assembly 102 for receiving a substrate to be polished and for holding the substrate in place for a polishing head 104 to pick up. The polishing head 104 is supported by an arm 106 that is operative to move the head 104 between the load cup assembly 102 and a polishing pad 108 on a rotating platen 110. In operation, the head 104 picks up the substrate from the load cup assembly 102 and carries it to the polishing pad 108. As the polishing pad 108 is rotated on the platen 110, the head 104 rotates and pushes the substrate down against the polishing pad 108. Note that the diameter of the polishing pad 108 is more than twice that of the substrate.

Figure 2:
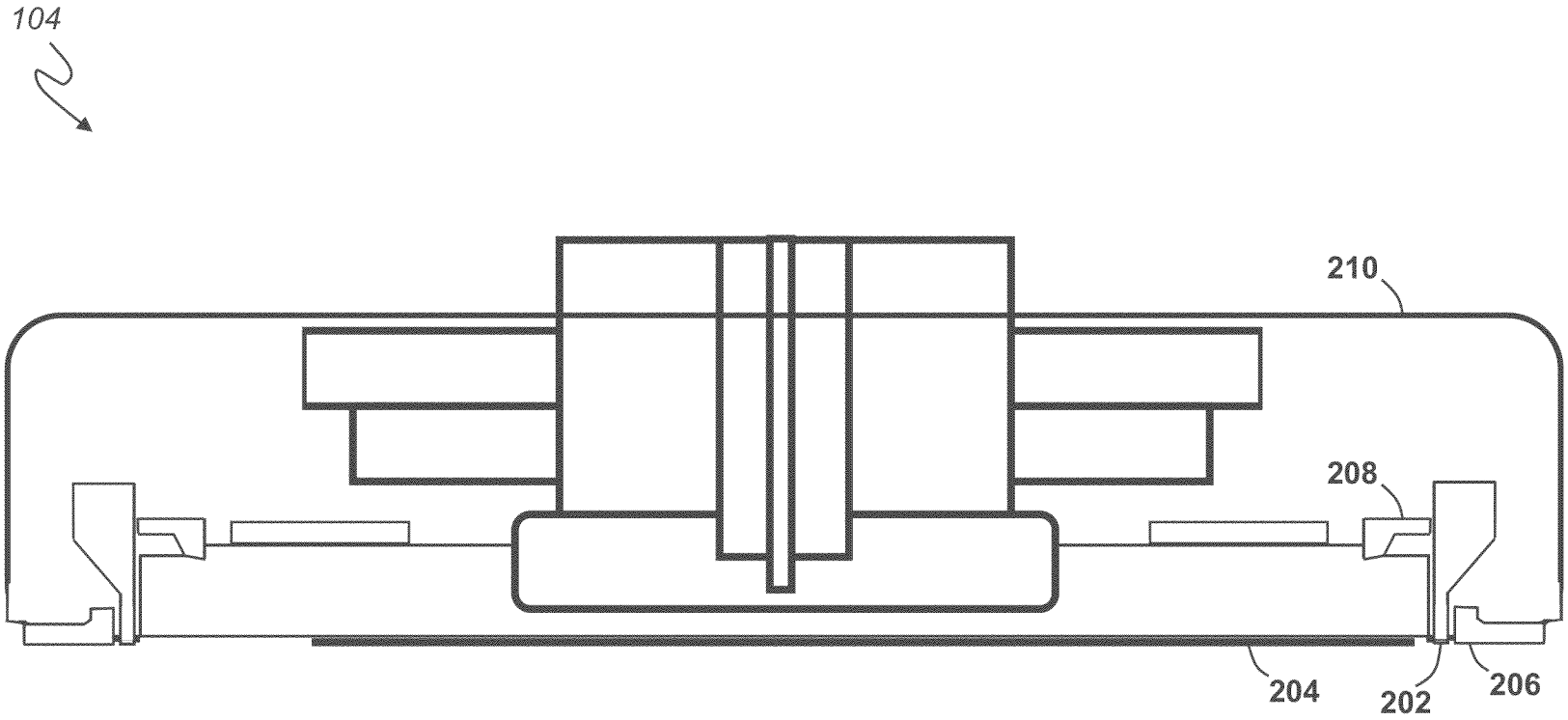
FIG. 2 is a schematic diagram depicting a side cross-sectional view of a polishing head of a CMP system according to embodiments of the present invention.
Figure 3:
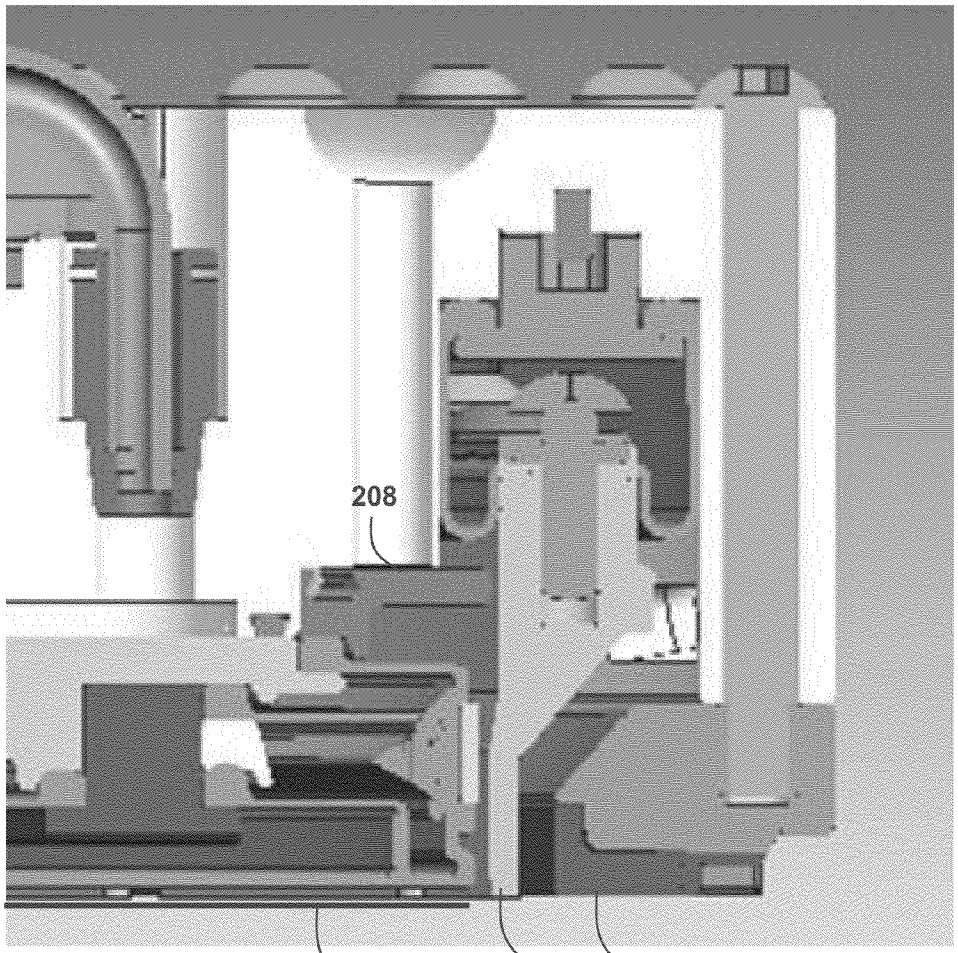
FIG. 3 is a schematic diagram depicting a partial side cross-sectional magnified view of a polishing head of a CMP system according to embodiments of the present invention.

Turning to FIGS. 2 and 3 which depict some details of the polishing head 104 in a cross-sectional view and a magnified, partial cross-sectional view respectively, the flexible inner retaining ring 202 extends down from the polishing head 104 to surround and retain the substrate 204 during polishing. The outer retaining ring 206 surrounds the inner ring 202 and the inner ring support 208 is disposed within the inner ring 202 and above the level of the substrate 204. The polishing head 104 includes a housing 210 that encloses the other components, a spindle for rotating the head 104, and also means for holding a substrate such as a bladder, a suction system, or other chucking devices.

Figure 4:
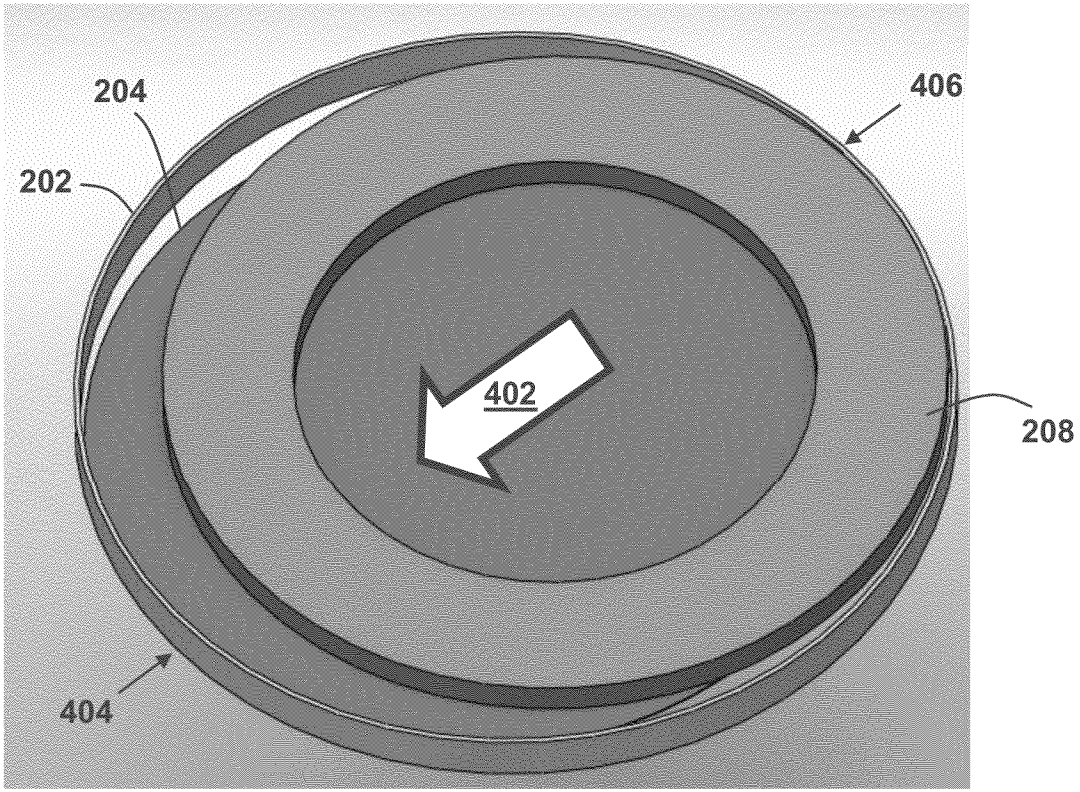
FIG. 4 is a schematic diagram depicting a perspective view of a flexible inner retaining ring and an inner support of a polishing head of a CMP system according to embodiments of the present invention.
Figure 5:
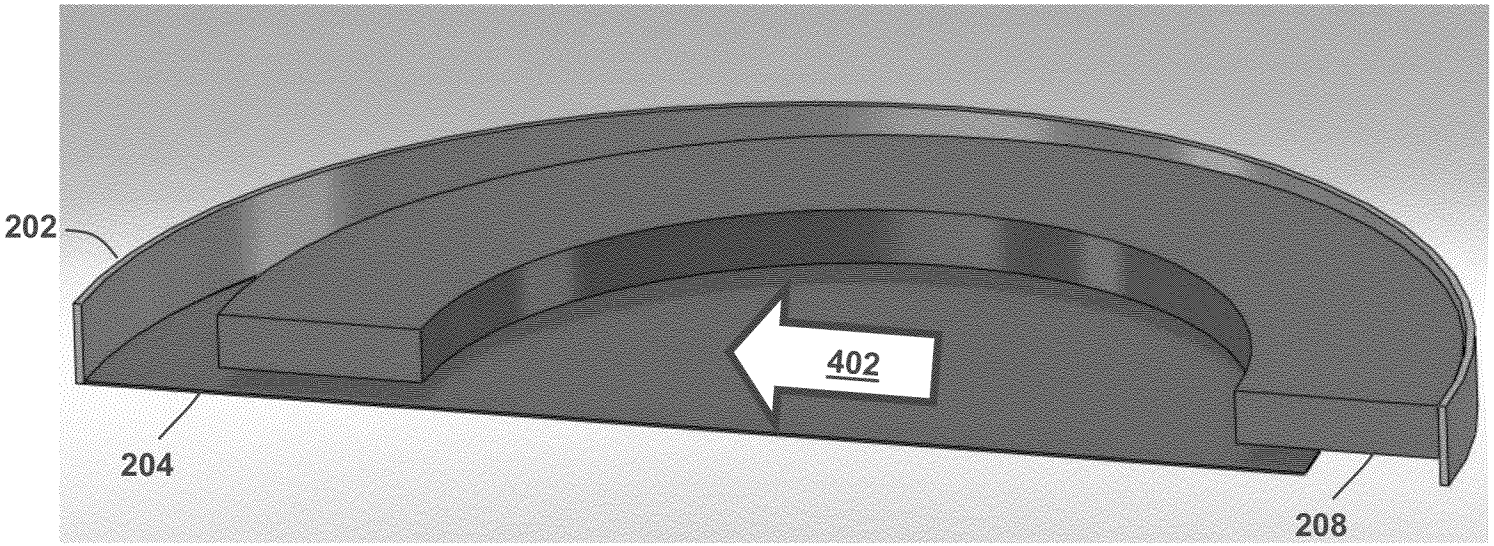
FIG. 5 is a schematic diagram depicting a cross-sectional perspective view of a flexible inner retaining ring and an inner support of a polishing head of a CMP system according to embodiments of the present invention.

Turning now to FIGS. 4 and 5, the lower portion of a flexible inner retaining ring 202 and an inner ring support 208 of a polishing head 104 (FIG. 3) are shown relative to a substrate 204. The inner ring support 208 is disposed above the substrate 204 and is rigidly attached to the polishing head 104 (FIG. 3).

As shown in the perspective view of FIG. 4 and the cross-sectional perspective view of FIG. 5, as the side force 402 is applied to the substrate 204 (by the rotation of the polishing pad 108 (FIG. 1)), the edge of the substrate 204 presses against the inside of the flexible inner retaining ring 202 at point 404. This causes the flexible inner retaining ring 202 to pull against the inner ring support 208 at point 406. Note that point 404 is on the opposite side of the flexible inner retaining ring 202 of point 406.

These forces distort the flexible inner retaining ring 202 into an oval shape with a portion of the flexible inner retaining ring 202 contacting and contouring to the edge of the substrate 204. This contouring of the flexible inner retaining ring 202 increases the amount of contact between the substrate 204 and the flexible inner retaining ring 202. This results in the stress of the side force 402 being distributed over a larger area and avoids concentrated stresses that might otherwise lead to failure of the retaining ring.

In some embodiments, the flexible inner retaining ring 202 may be constructed of Techtron PPS, Ertalyte PET-P, or Ketron PEEK material manufactured by Quadrant Corporation located in Reading, Pa., USA. Other practicable flexible materials may be used. The approximate thickness of the flexible inner retaining ring 202 may be in the range of approximately 1 mm to approximately 5 mm for retaining 300 mm size substrates. For larger substrates, a thicker flexible inner retaining ring 202 may be used.

In some embodiments, the flexible inner retaining ring 202 may have a diameter of approximately 301 mm to approximately 310 mm for retaining 300 mm size substrates. For larger substrates, a larger diameter flexible inner retaining ring 202 may be used. In some embodiments, the inner ring support 208 may have a diameter of approximately 300 mm to approximately 309 mm for retaining 300 mm size substrates. For larger substrates, a larger diameter inner ring support 208 may be used.

Figure 6:
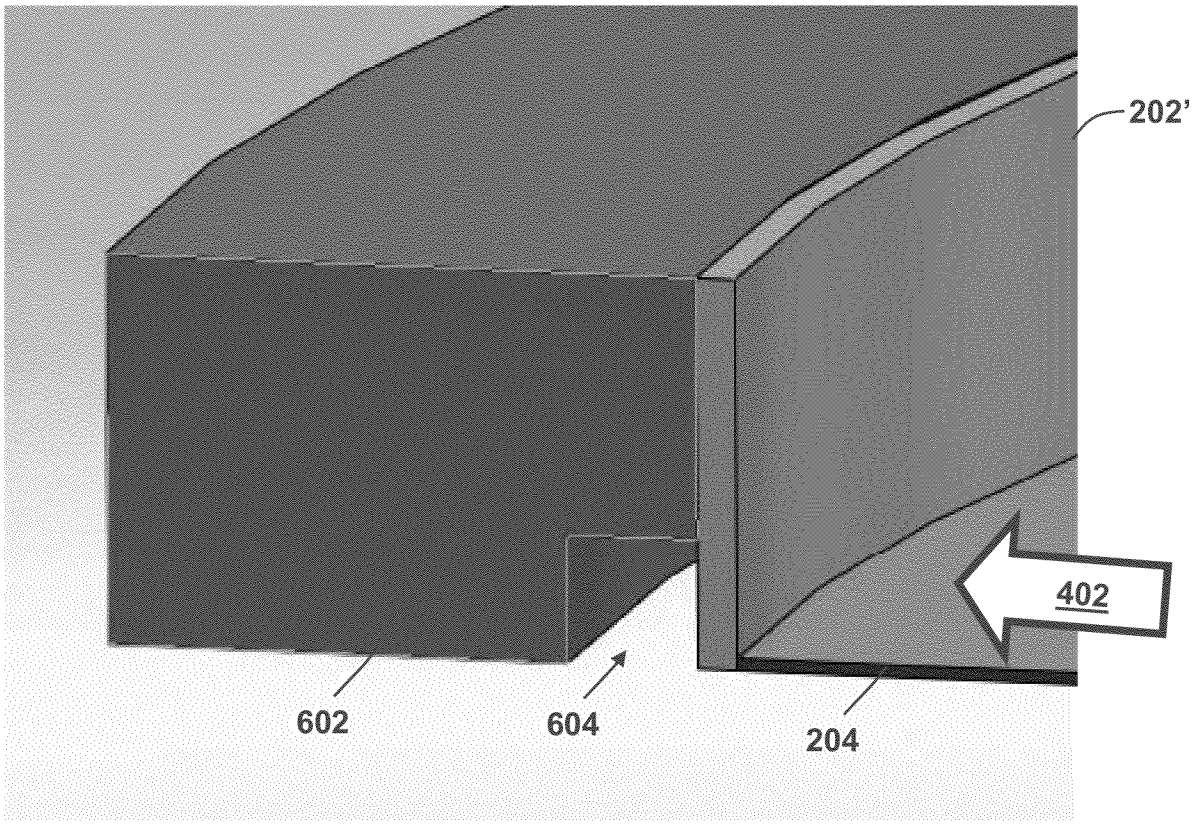
FIG. 6 is a schematic diagram depicting a partial cross-sectional perspective view of a flexible inner retaining ring and a notched outer retaining ring of a polishing head of a CMP system according to alternate embodiments of the present invention.

Turning now to FIG. 6, an alternative embodiment of the present invention is shown. Instead of using an inner ring support 208 as in the embodiment of FIGS. 4 and 5, this alternative embodiment includes an outer ring 602 that has a notch 604 in the lower, inner surface proximate to where the substrate contacts the flexible inner retaining ring 202' as shown in FIG. 6. This arrangement allows the flexible inner retaining ring 202' to flex and to be pushed into the notch by the side force 402 from the substrate 204.

In some embodiments, the flexible inner retaining ring 202' of this embodiment may be constructed of Techtron PPS, Ertalyte PET-P, or Ketron PEEK material manufactured by Quadrant Corporation located in Reading, Pa., USA. Other practicable flexible materials may be used. The approximate thickness of the flexible inner retaining ring 202' may be in the range of approximately 1 mm to approximately 10 mm for retaining 300 mm size substrates. For larger substrates, a thicker flexible inner retaining ring 202' may be used.

In some embodiments, the outer ring 602 of this embodiment may be constructed of Techtron PPS, Ertalyte PET-P, or Ketron PEEK material manufactured by Quadrant Corporation located in Reading, Pa., USA. Other practicable materials may be used. The approximate depth and height of the notch may be in the range of approximately 1 mm to approximately 10 mm for retaining 300 mm size substrates. For larger substrates, a notch of different dimensions may be used. In some embodiments, differently shaped notches may be used.

Figure 7:
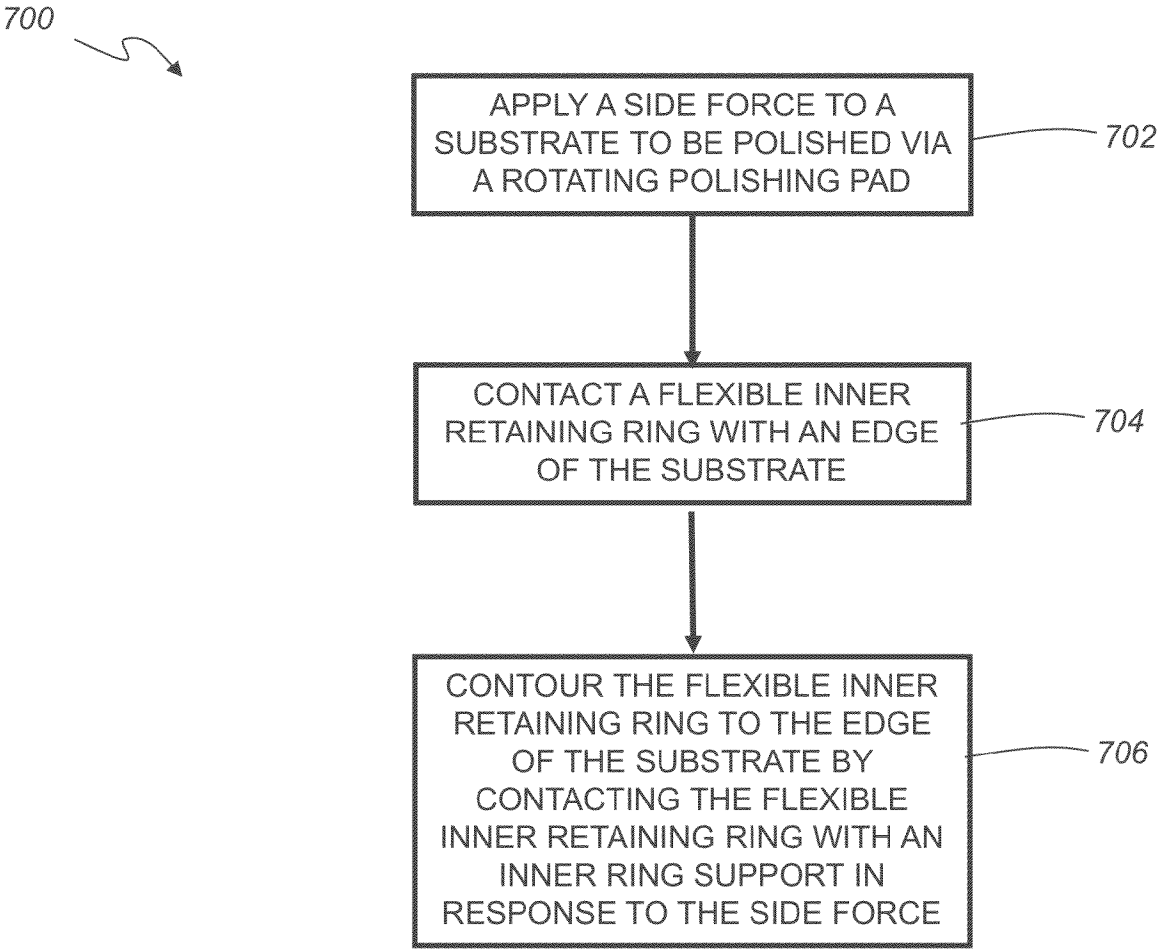
FIG. 7 is flowchart depicting an example method of retaining a substrate in a polishing head of a CMP system according to embodiments of the present invention.

Turning now to FIG. 7, an example method 700 of retaining a substrate in a polishing head 104 during processing is depicted in a flowchart. In step 702, a side force 402 is applied to a substrate 204 to be polished via a rotating polishing pad. In step 704, a flexible inner retaining ring 202 is contacted by an edge of the substrate 204. In step 706, the flexible inner retaining ring 202 is contoured to the edge of the substrate 204. This is done by contacting the flexible inner retaining ring 202 with an inner ring support 208 coupled to the polishing head 104 in response to the side force 402 being applied to the flexible inner retaining ring 202 by the substrate 204 being polished. The side force 402 is generated by friction from the polishing pad 108 rotating against the substrate 204.

In some embodiments, the inner ring support 208 contacts the flexible inner retaining ring 202 at least at a point 406 on the flexible inner retaining ring 202 opposite a point 404 that the substrate 204 contacts the flexible inner retaining ring 202. The inner ring support 208 is disposed above the substrate 204 within a circumference of the flexible inner retaining ring 202 and thus, the inner ring support 208 has a diameter smaller than the flexible inner retaining ring 202. In some embodiments, the polishing head 104 may also include an outer retaining ring 206 coupled to the polishing head 104 and disposed around the flexible inner retaining ring 202.

Accordingly, while the present invention has been disclosed in connection with the preferred embodiments thereof, it should be understood that other embodiments may fall within the spirit and scope of the invention, as defined by the following claims.

The invention claimed is:

1. An apparatus for retaining a substrate in a polishing head, the apparatus comprising:

a flexible inner retaining ring adapted to contour to an edge of a substrate; and an inner ring support coupled to the polishing head, disposed within the flexible inner retaining ring, and having a diameter small enough to fit within the flexible inner retaining ring without contacting the flexible inner retaining ring, wherein in response to a side force load applied to the flexible inner retaining ring by a substrate being polished, the inner ring support contacts the flexible inner retaining ring.

2. The apparatus of claim 1 wherein the inner ring support contacts the flexible inner retaining ring at least at a point on the flexible inner retaining ring opposite a point that the substrate contacts the flexible inner retaining ring.

3. The apparatus of claim 1 wherein the inner ring support is disposed above the substrate within a circumference of the flexible inner retaining ring.

4. The apparatus of claim 1 wherein the inner ring support has a diameter smaller than the flexible inner retaining ring.

5. The apparatus of claim 1 further comprising an outer retaining ring coupled to the polishing head and disposed around the flexible inner retaining ring.

6. The apparatus of claim 1 wherein the side force is generated by a polishing pad rotating against the substrate.

7. The apparatus of claim 1 wherein inner ring support has a disk shape.

8. A polishing head system for a chemical-mechanical planarization (CMP) tool, the polishing head system comprising:

a flexible inner retaining ring adapted to contour to an edge of a substrate;

an inner ring support coupled to the polishing head, disposed within the flexible inner retaining ring, and having a diameter small enough to fit within the flexible inner retaining ring without contacting the flexible inner retaining ring, wherein in response to a side force load applied to the flexible inner retaining ring by a substrate being polished, the inner ring support contacts the flexible inner retaining ring;

a housing enclosing the flexible inner retaining ring and the inner ring support.

9. The system of claim 8 wherein the inner ring support contacts the flexible inner retaining ring at least at a point on the flexible inner retaining ring opposite a point that the substrate contacts the flexible inner retaining ring.

10. The system of claim 8 wherein the inner ring support is disposed above the substrate within a circumference of the flexible inner retaining ring.

11. The system of claim 8 wherein the inner ring support has a diameter smaller than the flexible inner retaining ring.

12. The system of claim 8 further comprising an outer retaining ring coupled to the polishing head and disposed around the flexible inner retaining ring.

13. The system of claim 8 wherein the side force is generated by a polishing pad rotating against the substrate.

14. A method of retaining a substrate in a polishing head, the method comprising:

applying a side force to a substrate to be polished via a rotating polishing pad;

contacting a flexible inner retaining ring with an edge of the substrate; and contouring the flexible inner retaining ring to the edge of the substrate by contacting the flexible inner retaining ring with an inner ring support coupled to the polishing head in response to the side force being applied to the flexible inner retaining ring by the substrate being polished, wherein the inner ring support has a diameter small enough to fit within the flexible inner retaining ring without contacting the flexible inner retaining ring.

15. The method of claim 14 wherein the inner ring support contacts the flexible inner retaining ring at least at a point on the flexible inner retaining ring opposite a point that the substrate contacts the flexible inner retaining ring.

16. The method of claim 14 wherein the inner ring support is disposed above the substrate within a circumference of the flexible inner retaining ring.

17. The method of claim 14 wherein the inner ring support has a diameter smaller than the flexible inner retaining ring.

18. The method of claim 14 further comprising disposing an outer retaining ring coupled to the polishing head around the flexible inner retaining ring.

19. The method of claim 14 wherein the side force is generated by friction from the polishing pad rotating against the substrate.

20. An apparatus for retaining a substrate in a polishing head, the apparatus comprising:

a flexible inner retaining ring adapted to contour to an edge of a substrate; and an outer retaining ring surrounding the flexible inner retaining ring and including a notch disposed adjacent the flexible inner retaining ring to allow the flexible inner retaining ring to flex into the notch in response to a side force load applied to the flexible inner retaining ring by a substrate being polished.

* * * * *